US005303537A

United States Patent [19]

Kot et al.

[11] Patent Number: 5,303,537

[45] Date of Patent: Apr. 19, 1994

[54] APPARATUS FOR MAKING METALLIC CORD

[75] Inventors: Kenneth M. Kot, Akron, Ohio; Rene Seyll, Martelange, Belgium

[73] Assignee: The Goodyear Tire & Rubber Company, Akron, Ohio

[21] Appl. No.: 20,529

[22] Filed: Feb. 22, 1993

Related U.S. Application Data

[63] Continuation of Ser. No. 545,004, Jun. 28, 1990, abandoned.

[51] Int. Cl.[5] ..... D01H 7/90; D01H 13/04

[52] U.S. Cl. ..... 57/58.36; 57/58.38; 57/138

[58] Field of Search ..... 57/58.36, 58.38, 59, 57/314, 138, 352

[56] References Cited

U.S. PATENT DOCUMENTS

| | | | |
|---|---|---|---|
| 26,894 | 1/1860 | Pittman | 57/58.36 |
| 1,993,110 | 3/1935 | Myers | 57/138 |
| 3,791,127 | 2/1974 | Wesson | 57/58.82 |
| 3,872,659 | 3/1975 | Campbell et al. | 57/138 X |
| 3,955,348 | 5/1976 | Orlandi | 57/59 X |
| 4,495,759 | 1/1985 | Brandyberry et al. | 57/58.82 |
| 4,498,281 | 2/1985 | Wraight | 57/58.34 |
| 4,545,190 | 10/1985 | Rye et al. | 57/58.36 X |

FOREIGN PATENT DOCUMENTS

| | | |
|---|---|---|
| 0094336 | 5/1983 | European Pat. Off. . |
| 1008928 | 1/1950 | France . |
| 1425071 | 12/1965 | France . |
| 1-206519 | 8/1989 | Japan . |
| 2-14086 | 3/1990 | Japan . |
| 2020334A | 5/1978 | United Kingdom . |
| 2098251A | 5/1981 | United Kingdom . |

*Primary Examiner*—Daniel P. Stodola
*Assistant Examiner*—William Stryjewski
*Attorney, Agent, or Firm*—T. P. Lewandowski

[57] ABSTRACT

Apparatus for stranding together high tensile steel filaments to produce metallic cords, including a flyer having a forming die with its drawing axis merged with the flyer axis.

11 Claims, 3 Drawing Sheets

APPARATUS FOR MAKING METALLIC CORD

This is a continuation of application Ser. No. 07/545,004 filed on Jun. 28, 1990, now abandoned.

The present invention relates to an apparatus for stranding together high tensile steel wires, either individual separate wires referred to herein as filaments or strands of a plurality of filaments, to produce a metallic cord. The apparatus is particularly well adapted for making metallic cord to be used for reinforcing elastomeric articles such as tires, hoses or conveyor belts.

A high tensile steel filament can have a diameter between 0.15 and 0.38 mm. A tensile strength of about 3,250 $N/mm^2$ is for instance common for a filament having a diameter of 0.30 mm. The invention would be applicable to alloy steels as well, for example those having a Cr content.

The types of steel with which the invention is most concerned are carbon steels having a carbon content between 0.7 and 1.1% C, preferably between 0.8 and 1% C and further comprising up to 1% Mn, up to 0.5% Si, up to 0.04% P, up to 0.04% S, the balance being Fe and unavoidable impurities (all indicated percentages are by weight).

Cords are usually an assembly of 2 to about 30 filaments. For a given strength and filaments number, high tensile filaments require a smaller diameter than conventional filaments. This decrease in diameter leads in turn to a superior fatigue life, a lower weight of the cord and a lower overall gauge upon calendaring for a given thickness of elastomeric material on both sides of the cord fabric.

Unfortunately, the high carbon content of the filaments affects adversely their stiffness and high tensile filaments are more difficult to strand. The resulting cord has a high flare, a high end cast and important wildness variations, complicating the calendaring and cutting operations. By flare is meant the filament separation at the cut ends of the cord; this increased tendency of filament separation at the cut ends of the cords results for instance in an increased constraint over a local region at the edge of a cord reinforced rubber matrix. End cast is the deviation distance at the cut ends of the cord from the straight line defined by the rest of the cord. Wildness or residual torsion is the tendency of a given length of finished cord to rotate around its axis once an end has been freed. A rotation of up to three turns for a 6 m length of a given cord is considered acceptable in the tire field when the cords are balanced against each other in a calendar creel.

It is an aim of the instant invention to create an apparatus for making metallic cord constituted by high-tensile filaments having a reduced wildness and negligible flare.

A further aim of the invention is to improve the standard deviation of the lay length of the cord as well as to reduce the wildness variations within the same spool of cord.

A still further aim of the invention is to reduce the end cast and the bend of the cord.

These aims are met by apparatus for stranding together high tensile steel filaments to produce metallic cords adapted to be used as reinforcing elements in elastomeric structures, including a first member comprising a flyer having an axis of rotation (A) and means for rotating said flyer about said axis; a second member constituted by a non-rotating shuttle suspended from said flyer and comprising a set of spools supplying at least two filaments and rotatable pulleys for guiding the filaments until they reach a joining point; means for collecting the finished cord and means for drawing the filaments supplied by said set of spools around the components such as the above pulleys and through the members such as the above shuttle of said apparatus; a forming die having its drawing axis merged with the flyer axis; and means for guiding the filaments supplied by said set of spools so that they are generally equiangularly spaced around the drawing axis and form with said drawing axis an angle—comprised between 35° and 60°.

The cord wildness improvements achieved by the apparatus according to the invention over a prior art apparatus are a standard wildness deviation reduction from about 1.2 to 0.25 and a wildness range reduction from 3 turns per 6 meters to 1.5 turns per 6 meters. The flare of a cord is reduced from 50–100 mm obtained on a prior art apparatus, to 10 mm (average) observed on a cord made by an apparatus according to the invention, whereas the lay length standard deviation is reduced from 0.20 mm to 0.08 mm. The bend improvements are illustrated by a standard deviation reduction from 10 to 5 and a bend range reduction from 40 mm to 25 mm; the bend measurements are made on 650 mm long samples located between two sets of pins separated by a distance of 400 mm. All above data were obtained from 2×O.30 cords.

To acquaint persons skilled in the art most closely related to the instant invention, certain preferred embodiments are now described with reference to the annexed drawings. These embodiments are to be considered as being merely illustrative and can be modified in numerous ways within the spirit and scope of the invention defined in the claims.

Figure 1:
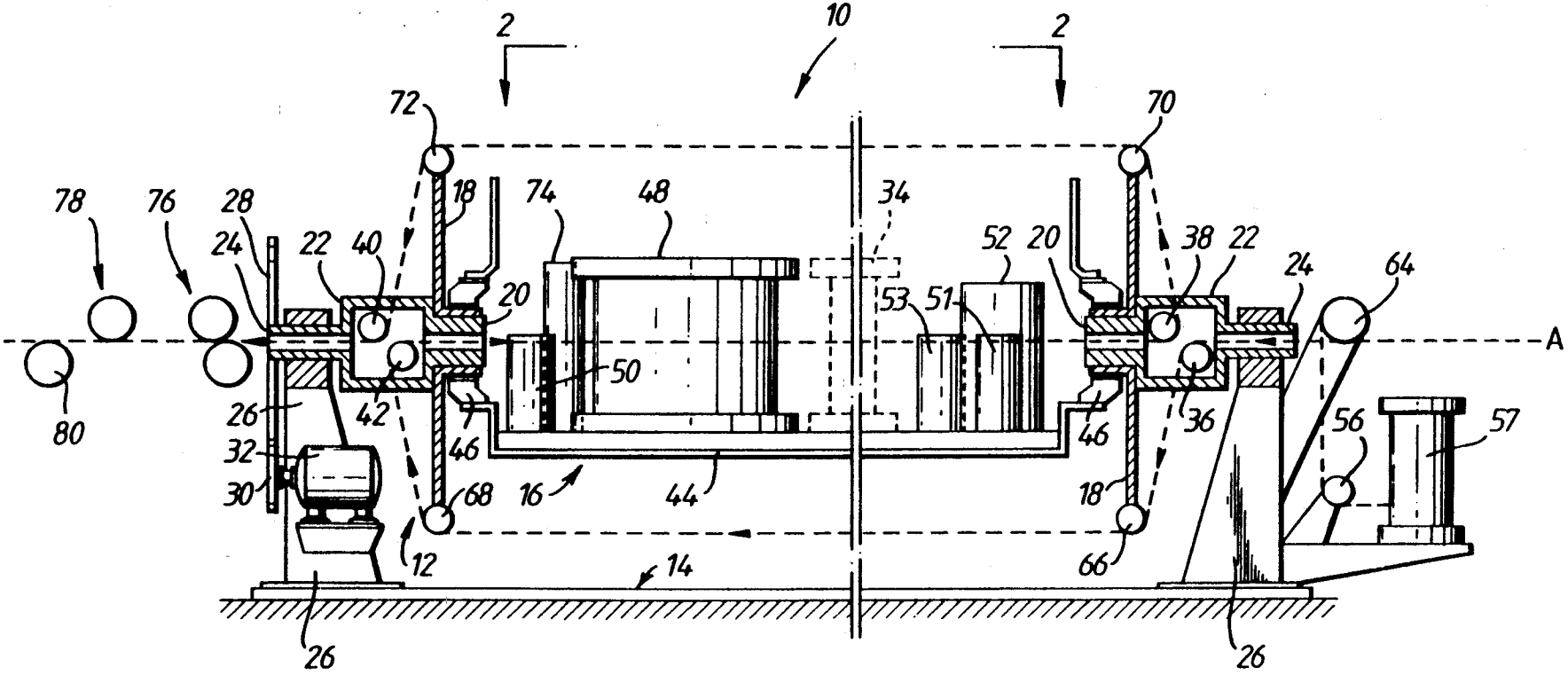
FIG. 1 is a schematic view of a machine which can be used for implementing the invention.

Referring to FIG. 1, a machine 10 is disclosed having a flyer 12 supported by a base 14 to rotate the flyer 12 about its own horizontal axis denoted by the letter A. A shuttle 16 is mounted co-axially inside the flyer 12 and rotates freely with respect to it, making it fixed relative to the rotating flyer 12.

The rotating flyer 12 has two discs 18 co-axially disposed and spaced apart but fixed with respect to one another. Each disc 18 has a hollow hub 20 fixed with respect to a frame 22 disposed axially outside the flyer 12, which, in its turn, is fixed with respect to a sleeve 24 which is also hollow and co-axial to the hub 20.

Each sleeve 24 is mounted in a corresponding support 26 of the base 14, through pulley bearings or ball bearings or any other arrangement that allows free rotation of the sleeve 24.

The sleeve 24 has a gear 28 co-axially affixed to it that engages with a corresponding gear 30 connected to a motor 32 fixed to the base 14.

Frames 22 support freely rotating sunken pulleys 36–42 which have axes of rotation perpendicular to the flyer axis A to which the pulley peripheries are tangential.

The hubs 20 extend within the flyer 12, and serve as a support for the shuttle 16 which has a frame work 44 supported by bushings 46 mounted on and co-axial with the hubs 20 to provide free rotation to the shuttle 16.

Figure 2:
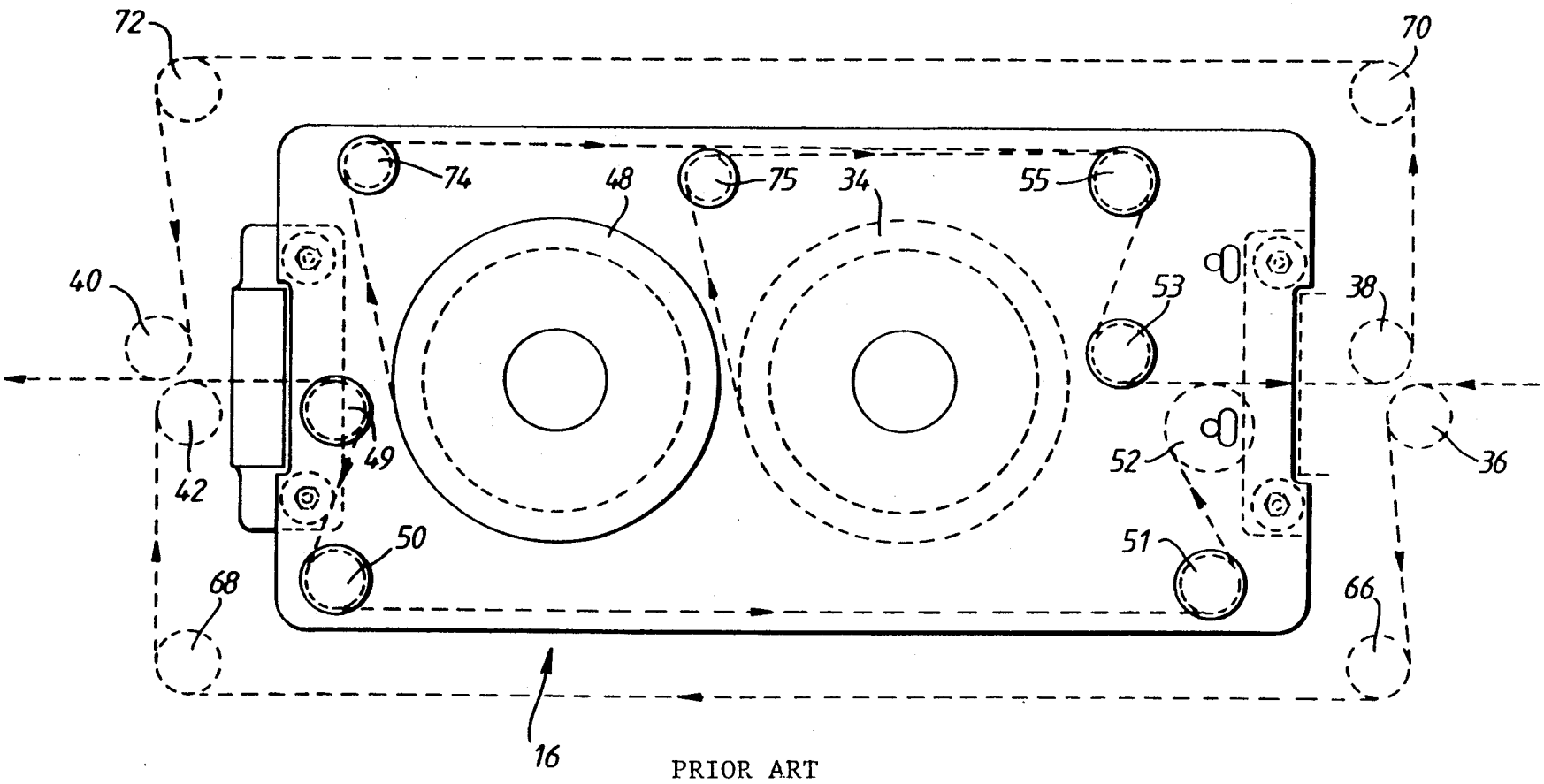
Fig. 2. PRIOR ART
FIG. 2 is a view taken along lines 2—2 of the machine in FIG. 1 and showing a known set-up.

As best illustrated in FIG. 2, the shuttle 16 supports internal spools of wire 34 and 48, idler pulleys 49, 50, 51, 52, 53, 55, 74 and 75, which have axes of rotation perpendicular to the flyer axis A. The idler pulleys are free to rotate about their axes while the spools 48 and 34 are provided with brakes to prevent the spools from overriding, the wire being let off of the spools. The brakes for the spools 48 and 34 are drag brakes or active brakes.

Filaments from several wire spools 57 (two in this example; the spools are not illustrated in detail) are gathered and pass from idler pulley 56 in an upward direction to the pulley 64 which can be provided with an adjustable brake. From the pulley 64 the two filaments (called hereafter the external filaments), pass through the hollow sleeve 24, and down over sunken pulley 36 across the flyer pulleys 66 and 68 and up over the sunken pulley 42 to reenter the shuttle 16 through the hollow hub 20. As best illustrated in FIG. 2, wherein the sunken pulleys 36–42 and flyer pulleys 66–72 are illustrated in phantom to better depict the path of the wire filaments, the two filaments pass from the sunken pulley 42 to the idler pulleys 49, 50 and 51, which guide the filaments around the wire spool positions to the pulley 52. In one rotation of the flyer 12, the two external filaments are given two turns in one direction.

A filament is drawn off of each of the internal wire spools 48 and 34 (called hereafter the internal filaments) around the guide idler pulleys 74 and 75 respectively, past idler pulley 55 to finally pass around the idler pulley 53 on the center line of the flyer 12, where they join the two external filaments as they all pass the point of tangency of the pulley 52 with the center line of the flyer 12. As all the all the filaments pass the sunken pulley 38 they are given one turn for every revolution of the flyer 12, but in the opposite direction to that given to the two external filaments which up to this point have had two turns for every revolution of the flyer. Thus, at this point the two external filaments having passed sunken pulley 38 have one turn left in the original direction and the two internal filaments drawn off internal spools 34 and 48 have gained one turn in the opposite direction. The four filaments pass over the flyer pulley 70 and across the flyer 12 to turn down over the flyer pulley 72 and around sunken pulley 40, putting another turn in the opposite direction in the two internal filaments drawn off internal spools 34 and 48, resulting in two turns being in these filaments while removing the second turn from the two external filaments. The two external filaments are now parallel (untwisted) because both the initial turns have been removed from them.

The finished cord passes through the hollow sleeve 24 of the flyer 12 as best illustrated in FIG. 1, and onto a false twist mechanism 76 illustrated schematically as two pulleys about which the finished cord makes a figure eight configuration to overtwist the cord thereby setting its configuration and then removing the overtwist, before passing onto the tensioning unit capstan 78 which supplies the pull through force for the machine 10. The cord then passes onto a wind-up spool 80, both the wind-up spool and tensioning unit capstan also being schematically illustrated in FIG. 1.

Figure 3:
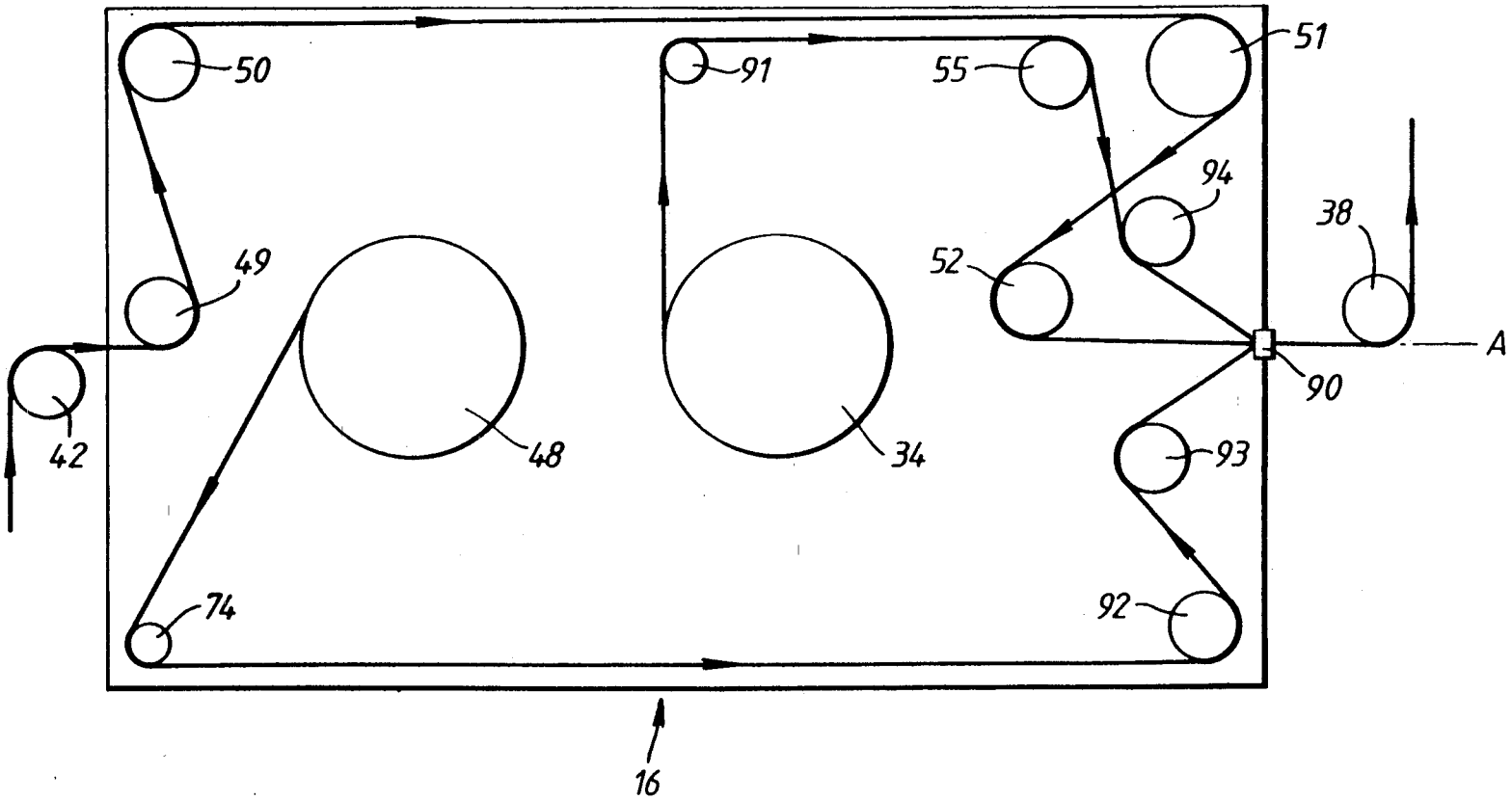
FIG. 3 is a view taken along lines 2—2 of the machine in FIG. 1 and showing a set-up according to the invention.

A set-up of the shuttle 16, modified according to the invention, is shown on FIG. 3, where devices and machine parts having the same function are marked with the same reference. The filaments originating from the internal spools 48 and 34 are drawn off in roughly opposite directions around the guide idler pulleys 74 respectively 91, past idler pulleys 92, 93 respectively 55, 94 to finally enter the forming die 90, where they join the two external filaments under an angle—defined by the relative position of the pulleys 93 and 94 and the forming die 90. It is preferred that, before entering the forming die 90, the four filaments are in the same plane which includes also the axis of the die which lies on the horizontal axis A of the flyer 12. The angle $\alpha$—formed by each of the filaments drawn off the internal spools with the horizontal axis A is comprised between 35° and 60° preferably between 45° and 50°. The precise angle value leading to the best results is primarily a function of the filament strength, its diameter, the rotating speed and the pull through force applied to the machine. The easiest way to tune the angle—consists in changing the position of the axis of each of the pulleys 93 and 94; a change in diameter of the pulleys is less advisable.

In the preferred embodiment described herebefore, the die is mounted in and rotates with the hollow hub 20. It is to be understood that the forming die can also take a fixed position relatively to the shuttle 16. The die can for instance be mounted on the framework 44 in front of the hollow hub 20 so as to have its axis on the flyer axis A.

The forming die is for instance made of carbide or ceramic material and its inner diameter should be comprised between 150 and 200% of the finished cable diameter and more preferably between 170 and 180% of the cable diameter.

The invention has been described with a view to a machine stranding a 2+2 cord. By varying the number of external wire spools (see reference 57 on FIG. 1) or internal wire spools (see references 48 and 34 on FIG. 2 and 3) it is for instance possible to strand 2x cord (no filament drawn from the external spools and hence the sole filaments drawn off from the internal spools 48 and 34 enter the drawing die under an angle—of about 45°), 3+2 cord (three filaments drawn off from the external spools and being parallel in the finished cord and two filaments drawn off from the internal spools) etc.

If more than two filaments are drawn off the internal wire spools, these filaments lie no more in the same plane before entering the forming die 90 but each filament forms with each neighboring filament substantially the same angle, the angle $\alpha$—formed by each filament with the axis of the die still being comprised between 35° and 60°. Put another way, the internal filaments are equiangularly spaced around the external filaments lying on the axis of the die.

We claim:

1. Apparatus for stranding together high tensile steel filaments to produce metallic cords adapted to be used as reinforcing elements in elastomeric structures, including a first member comprising a flyer having an axis of rotation (A) and means for rotating said flyer about said axis;

a second member constituted by a non-rotating shuttle suspended from said flyer and comprising a set of spools supplying at least two filaments and rotatable pulleys for guiding the filaments until they reach a joining point forming a finished cord, a means for collecting the finished cord and means for drawing the filaments supplied by said set of spools through the members of said apparatus;

a forming die having its drawing axis merged with the flyer axis; and means for guiding the filaments supplied by said set of spools so that they are generally equiangularly spaced around the drawing axis and form with said drawing axis an angle—comprised between 35° and 60°.

2. Apparatus according to claim 1, wherein the internal diameter of the die is between 150% and 200% of the diameter of the cord.

3. Apparatus according to claim 1, wherein the die is made of carbide.

4. Apparatus according to claim 1, wherein said spools supply 2 filaments.

5. Apparatus according to claim 1, further including a set of spools located near said first member supplying at least one filament and means for guiding the filament(s) onto the drawing axis of the die before entering the die.

6. Apparatus according to claim 1, wherein the non-rotating shuttle is suspended from the flyer by two co-axial hollow hubs and wherein the die is mounted for rotation in one of the hollow hubs.

7. Apparatus according to claim 1, wherein the non-rotating shuttle is suspended from the flyer by two co-axial hollow hubs and wherein the die is located at the joining point of the filaments into cord.

8. Apparatus according to claim 7, wherein the location of the axis of said pulleys can be continuously changed.

9. Apparatus according to claims 1 or 5, wherein the filaments have substantially the same diameter comprised between 0.15 and 0.38 mm.

10. Apparatus according to claim 1 or 5, wherein the angle—is comprised between 45° and 50°.

11. Apparatus according to claim 1 or 5, wherein the means for guiding the filaments, supplied by the spools located on the shuttle, into the die are pulleys.

* * * * *